United States Patent [19]

Igarashi et al.

[11] 4,442,179

[45] Apr. 10, 1984

[54] HEAT-SENSITIVE RECORDING PAPER

[75] Inventors: Akira Igarashi; Sukenori Nakamura, both of Shizuoka, Japan

[73] Assignee: Fuji Photo Film Co., Ltd., Shizuoka, Japan

[21] Appl. No.: 434,661

[22] Filed: Oct. 15, 1982

[30] Foreign Application Priority Data

Oct. 16, 1981 [JP] Japan ..... 56-165263

[51] Int. Cl.[3] ..... B41M 5/18

[52] U.S. Cl. ..... 428/220; 427/150; 427/151; 427/361; 427/363; 427/366; 428/211; 428/323; 428/336; 428/409; 428/488.1; 428/913; 428/537.5; 346/217; 346/226

[58] Field of Search ..... 282/27.5; 427/150–153, 427/180, 261, 288, 331, 359, 361, 363, 365, 366; 428/211, 323, 327, 331, 336, 409, 411, 488, 537, 913, 914

[56] References Cited

U.S. PATENT DOCUMENTS 4,032,690 6/1977 Kohmura et al. ..... 428/537
4,098,114 7/1978 Asao et al. ..... 428/914

*Primary Examiner*—Bruce H. Hess
*Attorney, Agent, or Firm*—Sughrue, Mion, Zinn, Macpeak and Seas

[57] ABSTRACT

A heat-sensitive recording paper which has on a paper support a heat-sensitive recording layer having received a surface treatment in such a state that the recording paper comes to contain moisture in a proportion ranging from 5 wt % to 12 wt % by drying after the coating of the heat-sensitive recording layer. The surface treatment is effected by passing the recording paper through a pressure applying means. The pressure applying means is constructed by metal roller heated up to a temperature of 40° C. to 60° C. and an elastic roller (made preferably of hard rubber). The recording layer is brought into a face-to-face contact with the metal roller.

9 Claims, No Drawings

HEAT-SENSITIVE RECORDING PAPER

FIELD OF THE INVENTION

The present invention relates to heat-sensitive recording paper. The term "heat-sensitive recording paper" means a type of recording paper which forms an image due to physical or chemical changes of some of its constituents caused by thermal energy applied to the paper.

BACKGROUND OF THE INVENTION

There have been a number of developments recently to improve the characteristics of heat-sensitive recording papers. These developments have been applied in practice to output paper for facsimiles and computers.

Many of these heat-sensitive recording papers are called the dye type. Examples of dye type papers are disclosed in U.S. Pat. Nos. 3,451,338 and 3,539,375, Japanese Patent Publication No. 4160/68 (U.S. patent application Ser. No. 512,546), Japanese Patent Application (OPI) No. 27253/80 (The term "OPI" as used herein refers to a "published unexamined Japanese patent application"), and so on.

In general, it is advantageous to use heat-sensitive coloring papers as recording papers because the recording apparatus therefor can be light weight and miniaturized. In recent years this advantage has rapidly improved the chances of using these heat-sensitive recording papers. However, a use of these heat-sensitive recording papers is not desirable in that recording cannot be carried out at a sufficiently high speed. In order to carry out high speed recording, a large amount of heat energy must be applied on the heat-sensitive recording paper in a short time because the amount of heat energy per unit area necessary for recording is constant. However, the recording element has a limited recording energy depending on the power of source. In order to subjugate this defect, various means have been devised both with respect to the recording apparatus and recording paper. A typical example thereof is the improvement of the surface smoothness of the heat-sensitive recording paper involving calendering processing.

However, such a surface processing cannot make the recording paper smooth without various disadvantages. One disadvantage is the occurrence of fog, that is, the color reaction which takes place in the course of the surface treatment resulting in undesired coloration in the recording paper. A proposed means of eliminating the disadvantage is the addition of grain-shaped wax. This was proposed in Japanese Patent Publication No. 14531/75 and U.S. Pat. Nos. 4,032,690 and 3,445,261. However, waxes usually have large heat capacities and require great heat upon fusion. Consequently, they retard the thermal response of heat-sensitive recording papers.

Another disadvantage is a lowered facility with respect to writting with a pencil, a ball-point pen or the like.

Yet another disadvantage is impediment to running of a recording paper on the recording element. More specifically, the recording paper sticks to the recording element at colored parts because the recording element is brought into very close contact with the recording paper.

Notwithstanding the disadvantages as described above, surface treatment to improve smoothness is carried out because the comparatively large contribution of improved smoothness gives toward increasing recording speed.

SUMMARY OF THE INVENTION

An object of the present invention is to provide a heat-sensitive recording paper which does not suffer from the above-described disadvantages and results in improved heat transfer efficiency between the recording element and the recording paper.

The above-described object is attained with a heat-sensitive recording paper which has on a paper support a heat-sensitive recording layer having received a surface treatment in such a state that the recording paper comes to contain moisture in a proportion ranging from 5 wt% to 12 wt% by drying after the coating of the heat-sensitive recording layer. The surface treatment being effected by passing the recording paper through a pressure applying means, which is constructed by a metal roller heated up to 40° C. to 60° C. and an elastic roller, with the recording layer being brought into a face-to-face contact with the metal roller.

DETAILED DESCRIPTION OF THE INVENTION

Heat-sensitive recording papers prepared in accordance with embodiments of the present invention can provide high density images. More specifically, the paper of the present invention can provide sufficient density so that when it is employed in actual recording in a facsimile or the like, notwithstanding its apparent low smoothnesses, that is, low Bekk smoothness as defined in JIS-P-8119, a clear image is produced. Furthermore, the papers of the present invention are free from fog, and have excellent writting facilities. These effects can be markedly heightened by using hard rubber as the material of the elastic roller. The hard rubber includes a rubber compounded with a large amount of sulfur and the coefficient of vulcanization with respect to the amount of the sulfur added is preferably about 25 to 45. The surface hardness of the hard rubber roller is preferably about 70 to 90 shore hardness.

The combination of a metal roller with an elastic roller is clearly advantageous. When the combination of only hard metal rollers is used as a pressure applying means the texture of the raw paper used as a support results in fog of the heat-sensitive recording layer in its original condition.

It is also disadvantageous for the water content of the heat-sensitive recording paper to be passed through a pressure applying means to be below 5 wt%. If the water content is below 5 wt%, the pressure fog is created, because increased pressure must be applied to the recording paper in order to obtain the desired effects (recording density). It is undesirable for the water content to be above 12 wt% because the heat-sensitive color-forming layer is apt to be transferred onto the metal roller surface staining the roller surface. More preferable results can be obtained when the water content is controlled to within the range of 7 wt% to 10 wt%.

Furthermore, it has been found that heating the metal roller up to a temperature ranging from 40° C. to 60° C. brings about greater improvement in surface smoothness and sufficient elevation of recording density under the same pressure condition. In addition, such a heating step can prevent the occurrance of troubles created by conventional surface treatments, e.g., sticking phenomenon, lowering of writting facility and so on.

When the temperature of the metal roller is below 40° C., the heating effects are hardly observed. On the other hand, when it is above 60° C., thermal fog may be generated.

The pressure condition to be applied during the surface treating step in order to obtain the desired heat-sensitive recording paper is about 25 to 250 kgw/m, preferably 30 to 150 kgw/m.

Heat-sensitive recording papers of the present invention are, in general, prepared by coating a heat-sensitive coating composition on a raw paper. Useful heat-sensitive coating compositions include dispersions in which an electron donating colorless dye like Crystal Violet lactone and an electron accepting compound like 2,2-bis(4-hydroxyphenyl)propane are dispersed in a form of fine particles measuring several microns or less in size in an aqueous solution of polyvinyl alcohol.

Preparation processes for such dispersions are described in U.S. Pat. Nos. 3,539,375 and 3,451,338 and Japanese Patent Application (OPI) Nos. 93492/80 and 14281/80. Dispersed particles contained in the heat-sensitive coating composition are preferably controlled so as to have a volume average size of 8 μm or less, more particularly 4 μm or less. These size ranges are preferred because a heat-sensitive color-forming layer is generally coated in a thickness of 5 to 10 μm. Therefore, if coarse grains are contained in the color-forming layer, sufficient smoothness cannot be obtained even when the surface treatment of the present invention is carried out.

The Bekk smoothness of the paper support used in the present invention is about 15 to 200 sec, preferably 30 to 100 sec, and the Bekk smoothness of the coated paper is about 100 to 200 sec, preferably 200 to 1000 sec.

The present invention will now be illustrated in more detail by reference to the following example. However, the present invention should not be construed as being limited to the following example.

EXAMPLE 1

20 kg of Crystal Violet lactone and 100 kg of a 10% aqueous solution of polyvinyl alcohol (having a saponification degree of 98% and a polymerization degree of 500) were placed in a 300 l of ball mill, and dispersed for 24 hours. Similarly, 20 kg of 2,2-bis(4-hydroxyphenyl)-propane and 100 kg of a 10% aqueous solution of polyvinyl alcohol were placed in a 300 l of ball mill, and dispersed for 24 hours. The thus obtained two dispersions were mixed in such a proportion that the ratio of the content of Crystal Violet lactone to that of 2,2-bis(4-hydroxyphenyl)propane becomes 1:5 by weight.

Further, to a 20 kg portion of the resulting mixture was added 5 kg of light and fine calcium carbonate. They are dispersed thoroughly to give a coating composition.

The heat-sensitive coating composition thus prepared was coated on raw paper having a weight of 50 g/m$^2$ and a Bekk smoothness of 25 sec at a coverage of 6 g/m$^2$ of solids. The coating was carried out by means of an air knife coater. The coated paper was dried and subjected to surface treatment by being passed through a pressure applying means comprised of the combination of a hard chrome plated roller with a hard rubber roller (having a Shore hardness of 80). Recording was carried out on the thus obtained recording paper using a recording element to which energy of 2 ms/dot and 50 mJ/mm$^2$ was applied with a density of 5 dots/mm in the main scanning and 6 dots/mm in the subscannning. The reflection density at 610 nm (corresponding to the wavelength at which the coloration body of Crystal Violet lactone exhibits its absorption maximum) was measured.

In addition, Bekk smoothness and writting facility of the heat-sensitive recording paper were evaluated.

Water contents and temperatures of the metal roller at the time of passage through the pressure applying means, and the results of evaluations under these conditions are shown in Table 1.

(The evaluation of writing facility was carried out using a ball-point pen and a pencil.)

It is apparent from Table 1 that the heat-sensitive recording papers prepared in accordance with the embodiments of the present invention exhibited excellent properties.

TABLE 1

| | Water Content (%) | Surface Temperature of Metal Roller (°C.) | Pressure (kg/cm) | Bekk Smoothness (sec.) | Recording Density | Writting Facility | Remark |
|---|---|---|---|---|---|---|---|
| Comparison | 3 | 20 | 2 | 110 | 0.92 | Not Blurred | |
| Comparison | 3 | 40 | 2 | 120 | 1.01 | Not Blurred | |
| Comparison | 3 | 60 | 2 | 120 | 0.98 | Not Blurred | |
| Comparison | 6 | 20 | 1 | 140 | 1.18 | Not Blurred | |
| Present Invention | 6 | 40 | 1 | 200 | 1.31 | Not Blurred | |
| Present Invention | 6 | 60 | 1 | 210 | 1.32 | Not Blurred | |
| Comparison | 6 | 80 | 1 | 220 | — | Not Blurred | Fog generates |
| Present Invention | 10 | 40 | 1 | 250 | 1.32 | Not Blurred | |
| Present Invention | 12 | 40 | 1 | 310 | 1.36 | Not Blurred | |
| Comparison | 14 | 40 | 1 | — | — | — | Metal roller was stained. |

While the invention has been described in detail and with reference to specific embodiments thereof, it will be apparent to one skilled in the art that various changes and modifications can be made therein without departing from the spirit and scope thereof.

What is claimed is:

1. A heat sensitive recording paper which has on a paper support base a heat-sensitive recording layer having received a surface treatment in such a state that said recording paper comes to contain moisture in a proportion ranging from 5 wt% to 12 wt% by drying after the coating of a heat-sensitive recording layer, said surface treatment being effected by passing the recording paper through a pressure applying means, which is constructed by a metal roller heated up to a temperature of 40° C. to 60° C. and an elastic roller, with the recording layer brought into a face-to-face contact with the metal roller.

2. A heat-sensitive recording paper as claimed in claim 1, wherein the elastic roller is comprised of hard rubber.

3. A method for producing a heat-sensitive recording paper, comprising the steps of:

providing a paper support base;

coating a heat-sensitive recording layer on a surface of the support base;

drying said layer on the support base; and surface treating said layer by passing the recording paper through a pressure applying means comprised of a metal roller heated to a temperature of from 40° C. to 60° C. and an elastic roller, such the recording layer contacts with the metal roller, pressure being applied in such a state that the heat-sensitive recording paper to be passed through a pressure applying means has a moisture content of from 5 wt% to 12 wt%.

4. A method for producing a heat-sensitive recording paper as claimed in claim 3, wherein the elastic roller is comprised of hard rubber.

5. A method for producing a heat-sensitive recording paper as claimed in any of claim 3 or 4, wherein the moisture content of the heat-sensitive recording paper to be passed is within the range of from 7 wt% to 10wt%.

6. A method for producing a heat-sensitive recording paper as claimed in claim 3, wherein the heat-sensitive layer has a thickness of from 5 to 10 μm.

7. A method for producing a heat-sensitive recording paper as claimed in claim 6, wherein the heat-sensitive recording layer is comprised of particles dispersed in a binder, wherein the particles have a volume average size of 8 μm or less.

8. A method for producing a heat-sensitive recording paper as claimed in claim 7, wherein the volume average size of the particles is 4 μm or less.

9. A method for producing a heat-sensitive recording paper as claimed in claim 3, wherein the surface hardness of the hard rubber roller is about 70 to 90 shore hardness.

* * * * *